US007648345B2

(12) United States Patent
Armer et al.

(10) Patent No.: US 7,648,345 B2
(45) Date of Patent: Jan. 19, 2010

(54) LIQUID PUMP WITH MULTIPLE CHAMBERS AND CONTROL APPARATUS

(76) Inventors: Albert Armer, 66 Greton Road, Winchcombe, Cheltenham, Gloucestershire GL54 5EL (GB); Timothy John Moffat Armer, 66 Greton Road, Winchcombe, Cheltenham, Gloucestershire GL54 5EL (GB)

( * ) Notice: Subject to any disclaimer, the term of this patent is extended or adjusted under 35 U.S.C. 154(b) by 410 days.

(21) Appl. No.: 10/518,633

(22) PCT Filed: Jun. 10, 2003

(86) PCT No.: PCT/GB03/02276

§ 371 (c)(1),
(2), (4) Date: Sep. 19, 2005

(87) PCT Pub. No.: WO04/001232

PCT Pub. Date: Dec. 31, 2003

(65) Prior Publication Data

US 2006/0115365 A1 Jun. 1, 2006

Related U.S. Application Data

(60) Provisional application No. 60/389,932, filed on Jun. 20, 2002.

(30) Foreign Application Priority Data

Jun. 20, 2002 (GB) ..... 0214231.3

(51) Int. Cl.
*F04F 1/06* (2006.01)

(52) U.S. Cl. ..... 417/133; 417/121; 417/128; 417/138; 417/142

(58) Field of Classification Search ..... 417/105, 417/107, 109, 115, 118, 61, 65, 120, 126–136, 417/137, 139, 142, 36–41; 137/565.17, 561 R, 137/594, 595, 206, 209
See application file for complete search history.

(56) References Cited

U.S. PATENT DOCUMENTS

| | | | | |
|---|---|---|---|---|
| 474,338 | A | 5/1892 | Dyer | |
| 1,006,540 | A * | 10/1911 | Emmons | 417/75 |
| 1,444,087 | A * | 2/1923 | Rogers | 417/131 |
| 1,628,608 | A | 5/1927 | Newhouse | |
| 2,669,941 | A * | 2/1954 | Stafford | 417/125 |
| 3,790,306 | A * | 2/1974 | Uefuji | 417/128 |
| 4,321,017 | A * | 3/1982 | Gottliebson | 417/128 |
| 5,582,469 | A * | 12/1996 | Jurgen | 303/119.3 |
| 6,015,267 | A * | 1/2000 | Yumoto | 417/54 |

FOREIGN PATENT DOCUMENTS

| | | |
|---|---|---|
| DE | 304197 | 3/1918 |
| FR | 936093 | 7/1948 |

* cited by examiner

*Primary Examiner*—Devon C Kramer
*Assistant Examiner*—Dnyanesh Kasture
(74) *Attorney, Agent, or Firm*—Young & Thompson

(57) ABSTRACT

Pumps for Steam Condensates and other Liquids, include receivers that may be connected firstly to the liquid source, and after filling are then pressurised to discharge the liquid to a transfer line, or to a vessel at a higher pressure than that of the source. The use of a small pilot valve to detect the liquid level, mounted externally to each receiver, and controlling the opening and closing of the pressurising and venting valves, enables an unusually low profile to be achieved.

16 Claims, 9 Drawing Sheets

LIQUID PUMP WITH MULTIPLE CHAMBERS AND CONTROL APPARATUS

CROSS-REFERENCE TO RELATED APPLICATIONS

This application claims priority to U.S. provisional application 60/389,932 filed Jun. 20, 2002; British patent application 0214231.3 filed Jun. 20, 2002; and PCT/GB 2003/002276 filed Jun. 20, 2002.

BACKGROUND OF THE INVENTION

The present invention relates to pumps for liquids and in particular, although not exclusively, to pumps for steam condensate.

Pumps utilising chambers that may be allowed to fill by gravity to a chosen level and that are then pressurised using either the vapour of the liquid being pumped, or air (or sometimes an inert gas), to push the liquid from the chamber, are often described as "pressure-powered" pumps. The liquid enters and leaves the chamber through "non-return" or "check" valves. At the top of the chamber are two much smaller valves. The first one of these admits the pressurising or "motive" gas when it is open. The second one is a vent valve for releasing the motive gas from the chamber. The motive gas valve and the vent valve may be pneumatically actuated. In the case of one pattern presently used, the pneumatic signals to the valve actuators are controlled by electrical level probes in the chamber. Alternatively, the two valves may be actuated by electric motors or solenoids, these again responding to electric level probes or level switches.

Other pressure-powered pumps in use at present, such as the pump 1 illustrated in FIG. 1, have a relatively large float 2 carried on a lever arm 4 within the chamber 6. As the chamber fills with liquid, the buoyancy of the float 2 acting on the lever 4 applies force to one or more springs 8 which store energy as the float rises. At the upper tripping point the energy stored in the springs 8 is applied to a pushrod 10. This moves in such a manner as to close the vent valve 12 and to open the motive gas valve 14. The pressure in the chamber 6 then rises, closing the condensate inlet check valve 16, and at a sufficient value discharging the condensate through the outlet check valve 18.

As the condensate level in the chamber 6 falls, the float 2 is lowered, and its weight acting on the lever arm 4 again applies force to the springs 8. At the lower tripping point, the mechanism trips in the reverse manner and the energy stored in the springs 8 is applied to the push rod 10 in the opposite direction, so as to close the motive steam valve 14 and open the vent valve 12. The chamber pressure then falls as the motive steam is released and the next cycle begins. During the "discharge" phase of the cycle, condensate cannot enter the chamber, so a receiver is needed to accept and store the condensate until it can flow into the chamber at the start of the next cycle.

FIG. 2 shows an example of a pump 1 and an associated receiver 20 accepting condensate from a heat exchanger 22. Steam enters the heat exchanger 22 via a pipe 22A. The receiver 20 often is of a volume comparable to that of the chamber 6, and it is mounted at a height so as to permit gravity flow into the chamber at a desired rate. A trap 20A is fitted between the heat exchanger and the receiver 20. The drainage outlets 24 on the equipment from which the condensate is flowing must be at an even greater height to allow gravity drainage to the receiver 20 if the condensate is to flow when the source is at low or atmospheric pressure.

Condensate flow from the receiver 20 to the pump chamber 6 is intermittent, so the pipe sizes used often must be greater than those needed for continuous flow. Equally, flow in the delivery pipe 26 from the pump 1 occurs only during the discharge phase, so the instantaneous flow rate is higher than the average rate. Often increased pipe sizes are needed, compared with those that would be adequate with continuous flow.

Such existing pumps can be effective but have several drawbacks. First, they are inherently intermittent in action, requiring over-sizing of associated pipe work. Second, the pump chamber must be sufficiently tall to provide enough movement of the float, which also needs to be large itself, so that enough operating power is obtained to open and close the motive steam and venting valves against the pressures being used. Furthermore, the receiver must be at a sufficient height to allow gravity drainage to the pump chamber, and so steam-using equipment and steam traps often must be higher still. This can increase the costs involved in mounting the steam-using equipment at sufficient elevation or, where equipment is already installed, may preclude drainage to the pump of condensate.

Another disadvantage associated with existing pumps is that the operating power of the mechanism is stored in one or more springs that are highly stressed. The springs are compressed or extended and released twice during each cycle of the pump, and are subjected to the severe conditions that exist within the operating chamber of the pump. Any replacement of a failed spring can only be effected after removal of the mechanism from the pump chamber. Similarly, removal of the mechanism from the pump chamber is needed before any maintenance work needed on other parts of the mechanism can be performed, or re-adjustment of the settings of the tripping levels. If any electrically operated probes, controllers or motors are used then these require special protection in locations that are dirty, steamy, or where inflammable vapours may be present.

SUMMARY OF THE INVENTION

According to a first aspect of the present invention there is provided pump apparatus including:

a first container including a chamber, an inlet and an outlet, the chamber being pressurisable to effect discharge through the outlet;

a control apparatus for causing periodic pressurisation and depressurisation of the chamber in response to the level of liquid in the container, wherein the control apparatus includes a pilot valve located in a second container connected to receive liquid from the first container when the level of liquid in the first container reaches a predetermined level, the pilot valve being configured to trigger a pressurisation/depressurisation cycle in response to the liquid level in the second container.

The outlet will normally include a non-return valve. During pressurisation motive gas enters the container, thereby causing the pressure of the liquid to exceed the outlet valve threshold. A shuttle valve may be used to allow the motive gas to enter or be vented from the container.

The second container can be relatively small compared with the first container. The second container may have its base at a relatively higher location than the base of the first container. The first and second containers may be linked by a pipe or line having a non-return valve.

The apparatus may further include a compressed air supply. The compressed air may be used as the motive gas. In an alternative embodiment, steam is used as the motive gas. In one embodiment, the compressed air is supplied to or vented from one or more thruster cylinder which operates to supply or vent steam (or any other suitable gas or vapour) for pressurisation/depressurisation of the container.

The pump apparatus may include two pumps substantially as described above, the apparatus further including a further valve component connected to a line for venting the motive gas from the containers of each pump, the further valve configured to open the venting valve of one pump when the venting valve of the other pump is closed.

According to a second aspect of invention there is provided pumping apparatus including two pumps, each said pump respectively including:

a first container including a chamber, an inlet and an outlet, the chamber being pressurisable to effect discharge through the outlet;

a control apparatus for causing periodic pressurisation and depressurisation of the chamber in response to the level of liquid in the container; the apparatus being arranged so that when one said pump is discharging liquid, the other pump is receiving liquid through its inlet.

Pumps according to the invention can be suitable for pumping liquids that may be unsuitable for pumping by the use of centrifugal or other rotating pumps, or may be used in locations where electrically powered or controlled pumps would be undesirable or hazardous. The two pumps may be connected together by means of a further valve component having an automatic valve in the inlet line of each said first chamber, the valves arranged such that when the chamber of one said pump is discharging, the other said pump is receiving liquid through its inlet.

Whilst the invention has been described above, it extends to any inventive combination of the features set out above or in the following description.

BRIEF DESCRIPTION OF THE DRAWINGS

The invention may be performed in various ways, and, by way of example only, embodiments thereof will now be described, reference being made to the accompanying drawings, in which.

DETAILED DESCRIPTION OF THE PREFERRED EMBODIMENTS

Figure 1:
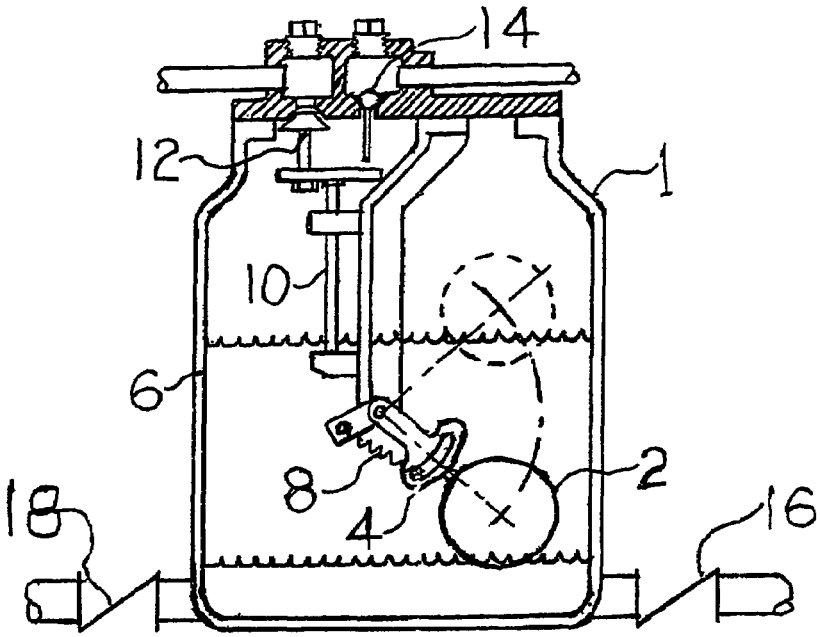
FIG. 1 (PRIOR ART)
FIG. 1 is a side view of a conventional pressure-powered pump.
Figure 2:
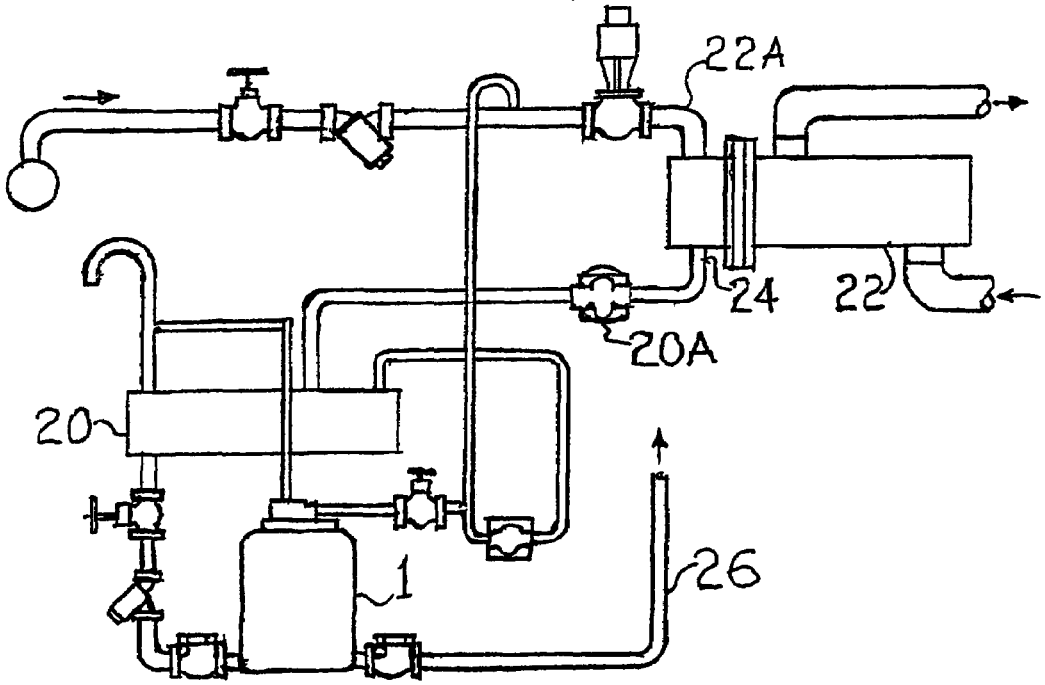
FIG. 2 (PRIOR ART)
FIG. 2 illustrates schematically the pump of FIG. 1 being used to pump heat exchanger condensate.
Figure 3:
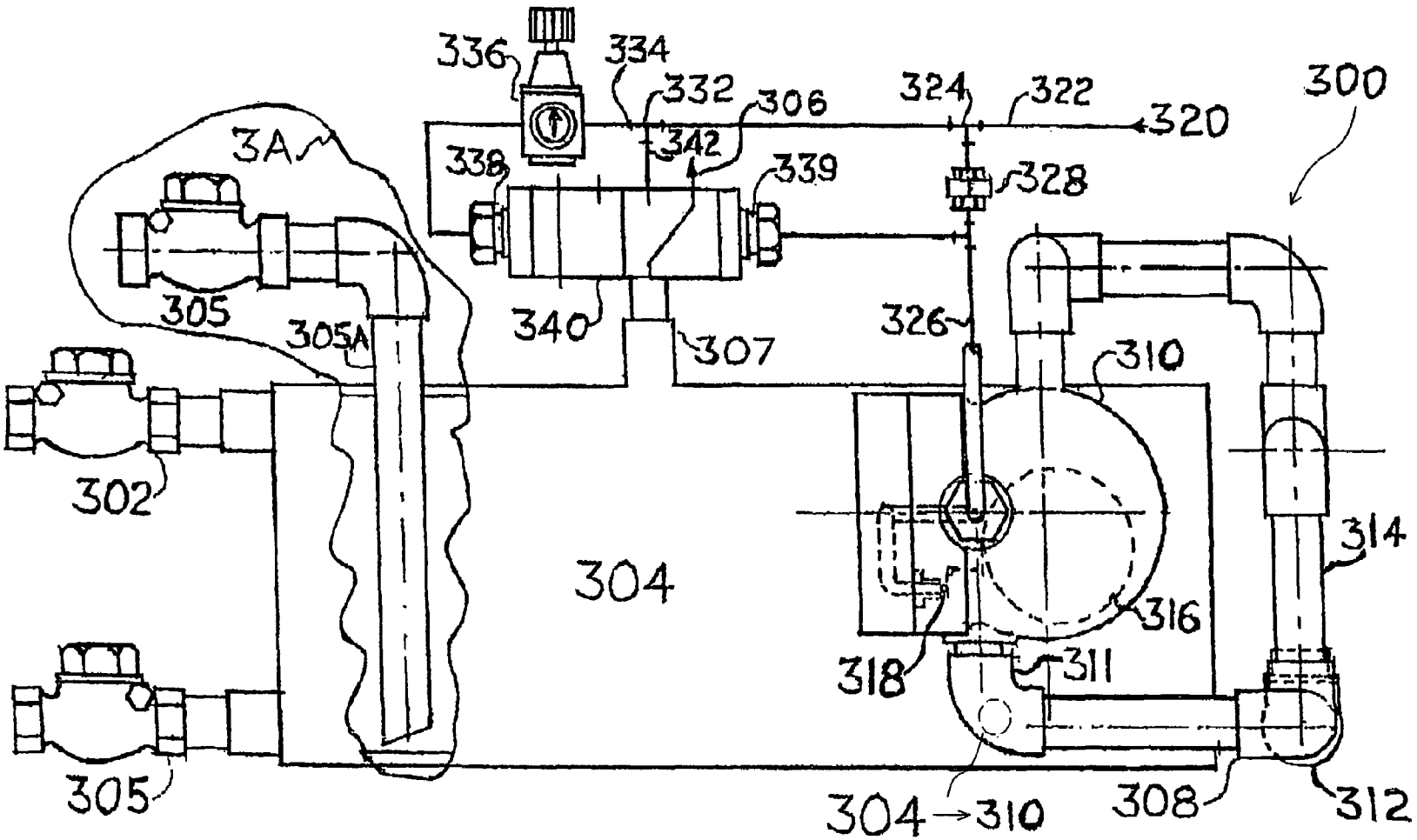
FIG. 3 is a side view of a first embodiment of a pump according to the present invention.

FIG. 3 shows an embodiment of the pump 300 where compressed air is used as the motive gas. The liquid to be pumped flows from a receiver tank (not shown) through a high-level non-return valve 302 into a chamber 304. The valve 302 is located near the top of the chamber 304. In the embodiment of FIG. 3 the chamber is also connected to a second non-return valve 305 by a pipe that is located near the base of the chamber 304.

In an alternative embodiment, a "dip" pipe 305A passes through the top of the chamber 304 to near the bottom of the chamber, the valve 305 being located above the top of the chamber. This arrangement can allow the liquid level in the chamber 304 to fall to a lower level. The possible dip pipe 305A and valve 305 are shown within the line 3A in FIG. 3.

The valve 305 is intended to act as an outlet. A vent pipe arrangement 307 is connected to the upper portion of the chamber 304 which is intended to allow gas in the chamber to be vented as liquid enters. The chamber 304 is connected to a substantially horizontal pipe 308 (of ½" or 15 mm nominal size) fitted with a non-return valve 312. The valve 312 can be of the swing check pattern or another type opening to a similar head of liquid. A vertical pipe 311 leads from the pipe 308 to a pilot valve chamber 310 which is relatively small compared with the main pump chamber 304. The chamber 310 may be cuboid or cylindrical in shape or it may be shaped as shown in the Figure. The chamber 310 contains a small float 316 attached to a valve 318.

A compressed air supply at location 320 is connected to a line 322 having a T-junction 324. One branch of the junction leads down to a line 326 connected to the valve 318. The line 326 incorporates an orifice restrictor 328 having a pass area much less than that of the valve 318. The pressure between 328 and 318 in line 326 downstream of restrictor 328 and upstream of valve 318 may be at least ⅔ to 1 bar below supply pressure when the float valve 318 is open (an orifice diameter of 2 mm through which a split pin is fitted can function satisfactorily).

The other branch of the junction 324 leads to a line that is fitted with a T-junction 332. One branch 334 of the junction 332 passes through a small pressure regulator valve 336 to one port 338 of a three-port shuttle valve 340. The opposing port 339 is connected to a part of the pipe 326 below the orifice fitting 328. The pilot port 338 is subjected to an air pressure that is maintained by the regulator valve 336 at a level around ½ bar less than the maximum pressure at the port 339. The valve 340 is connected to the chamber 304 and can switch between a first position where gas in the chamber can pass out through a vent 306 and a second position where compressed air can enter the chamber via a second branch 342 of the T-junction 332.

Operation of the pump 300 will now be described. The liquid to be pumped flows through the high-level non-return valve 302 into the chamber 304. At this point air in the chamber 304 can be displaced through the vent line 306. Liquid in the chamber is allowed to flow through the horizontal pipe 308 towards the pilot valve chamber 310. The liquid cannot pass in this direction through the non-return valve 312. When the liquid in the chamber 304 has reached a sufficiently high level it can overflow through the vertical pipe 314 into the chamber 310. The liquid surface area within chamber 310 is much less than that in chamber 304 and so the rate at which chamber 310 fills is very rapid compared with the slower progressive filling of chamber 304. When the liquid level in the chamber 310 is sufficiently high the float 316 is moved to open the valve 318. Air from line 326 then flows into the pilot valve chamber 310 and the main pump chamber 304. Thus, the pressure in pipe 326 is lowered, causing the shuttle valve 340 to change over and apply motive air.

Figure 4:
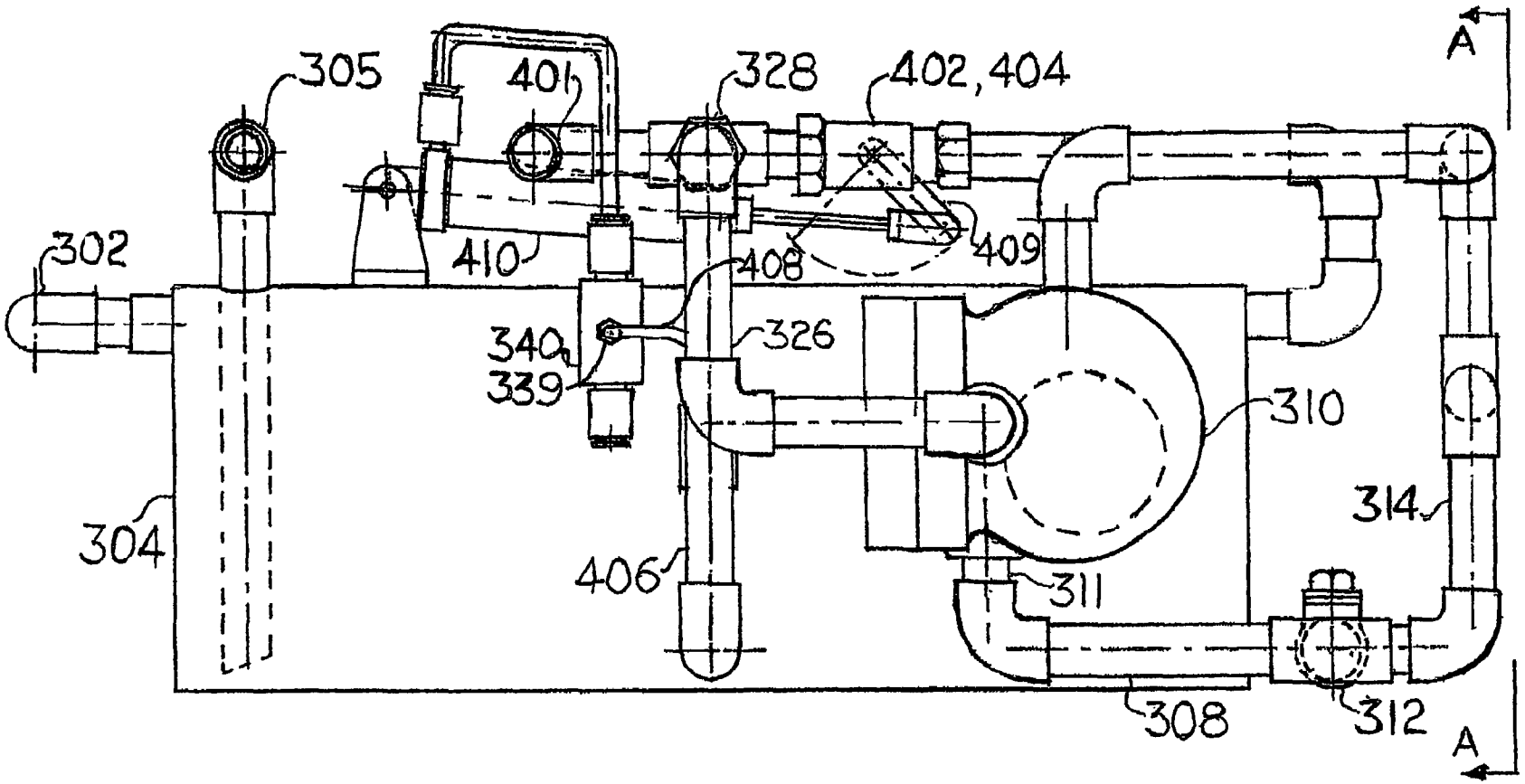
FIG. 4 is side view of a second embodiment where steam is used as the motive gas.

In steam/condensate applications, the use of steam as the motive gas is often desirable, and a pump arrangement 400 such as that shown in FIG. 4 may be applicable. Parts substantially similar to those of the embodiment of FIG. 3 are given identical reference numerals and will not be described in detail again. Motive steam passes through a Wye strainer 401 and is admitted to the chamber 304 through a quarter-turn ball valve 402. The valve can be as small as ¼" or 7.5 mm nominal size for condensate loads of up to about 5000 Liters per hour. A vent valve 404 is a similar ball valve of ½" or 15 mm nominal size. The operating levers 409 of the valves are turned by the action of one or more pneumatic "thruster" cylinders 410 of the spring return type that are supplied with compressed air, or are vented, through a shuttle valve 340 substantially as previously described.

In steam/condensate applications, the use of steam as the motive gas is often desirable, and a pump arrangement 400 such as that shown in FIG. 4 may be applicable. Parts substantially similar to those of the embodiment of FIG. 3 are given identical reference numerals and will not be described in detail again. Motive steam passes through a Wye strainer 401 and is admitted to the chamber 304 through a quarter-turn ball valve 402. The valve can be as small as ¼" or 7.5 mm nominal size for condensate loads of up to about 5000 Liters per hour. A vent valve 404 is a similar ball valve of ½" or 15 mm nominal size. The operating levers 409 of the valves are turned by the action of one or more pneumatic "thruster" cylinders 410 that are supplied with compressed air, or are vented, through a shuttle valve 340 substantially as previously described.

U-seals 406 are built into the pipe work so that steam cannot reach the shuttle valve pilot ports 338, 339. The seals can sense the pressure of air trapped in a pipe 408 leading to the shuttle port 339.

The operating levers 409 of the two ¼-turn ball valves 402, 404 may be linked together and operated by a single thruster 410, or each may have its own thruster. Addition of an extra vent valve, as described below, enables a duplex arrangement to be adopted.

Figure 5:
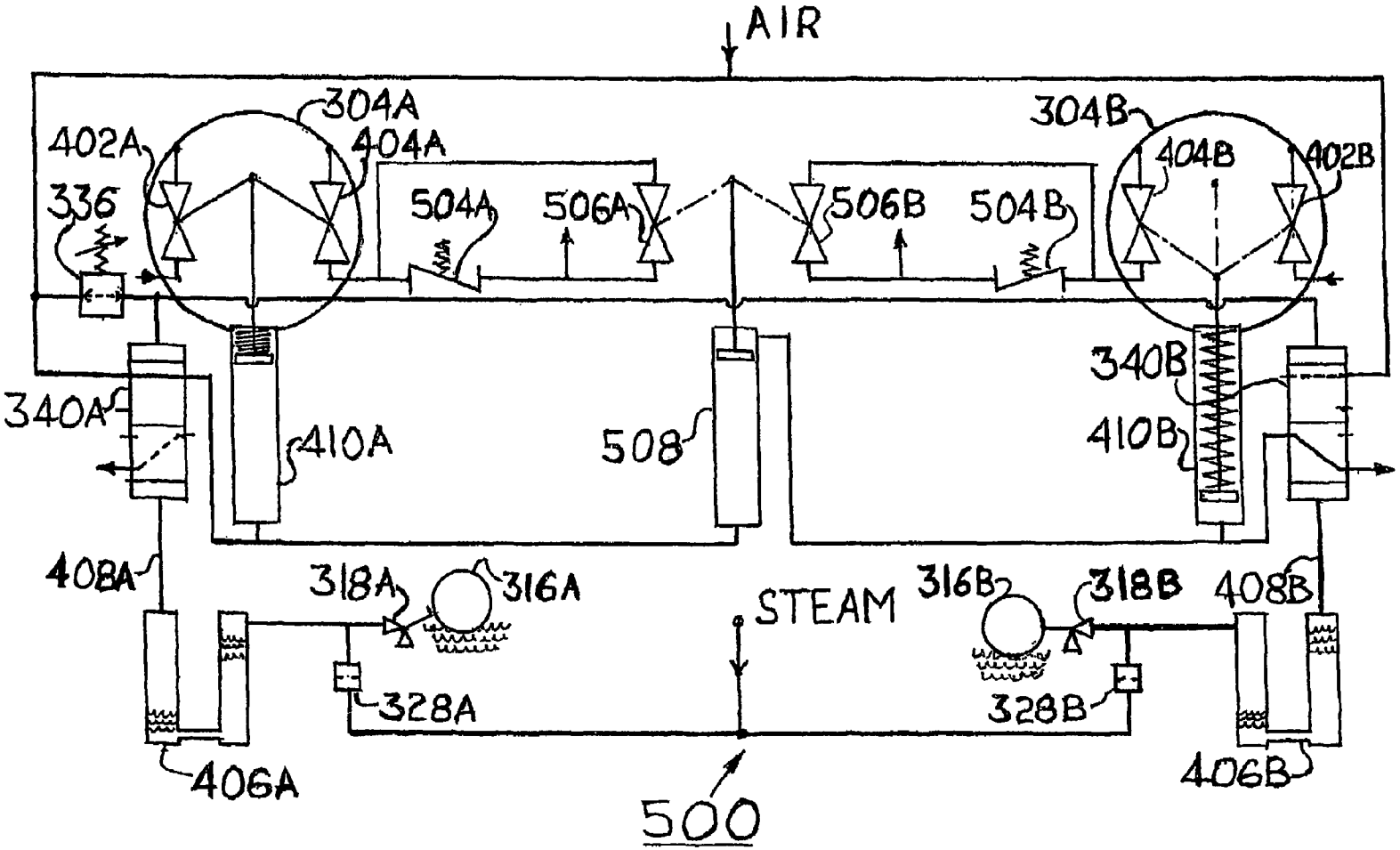
FIG. 5 illustrates schematically a third embodiment having a duplex arrangement.
Figure 6:
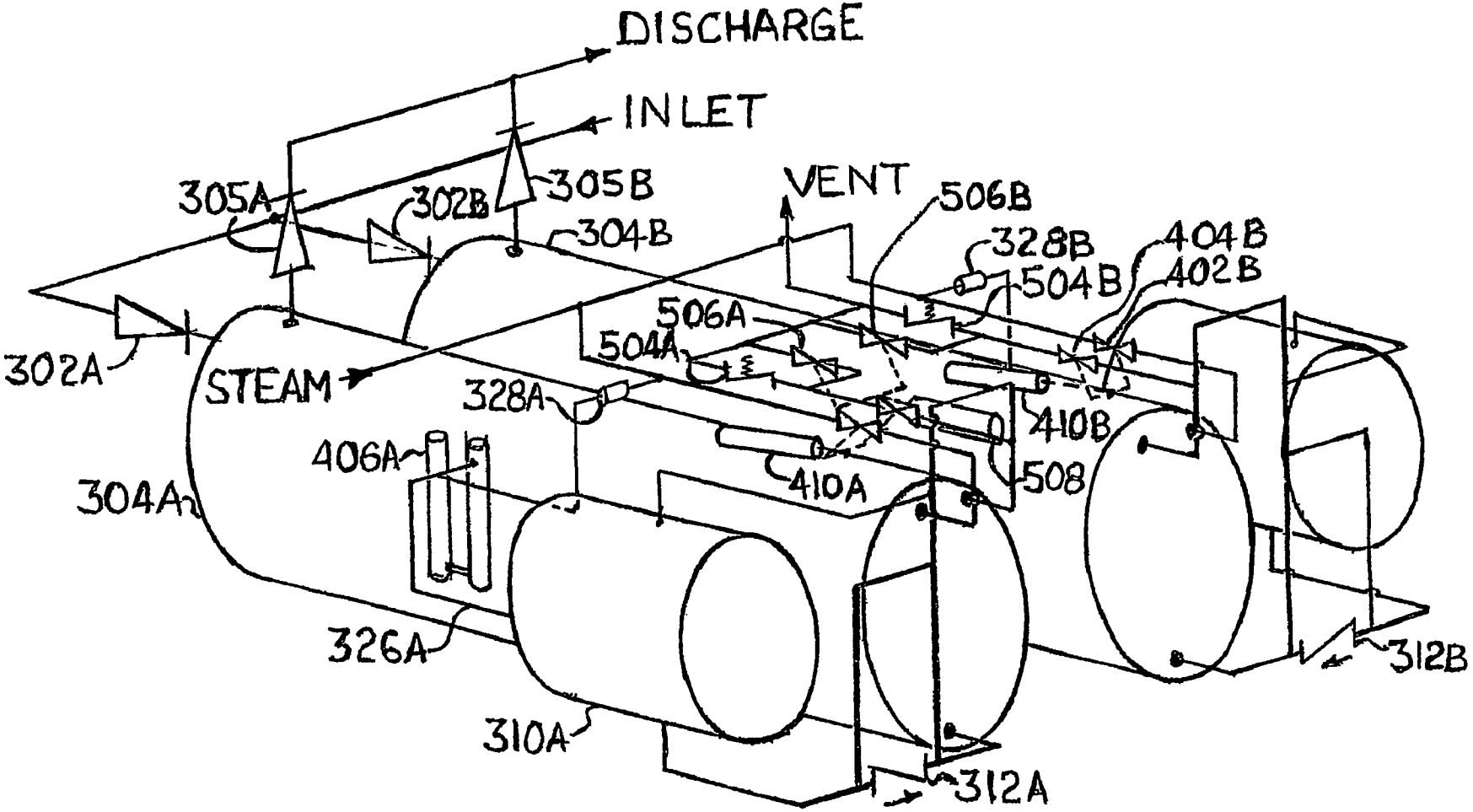
FIG. 6 is a schematic perspective view of the pump of FIG. 5.
Figure 7:
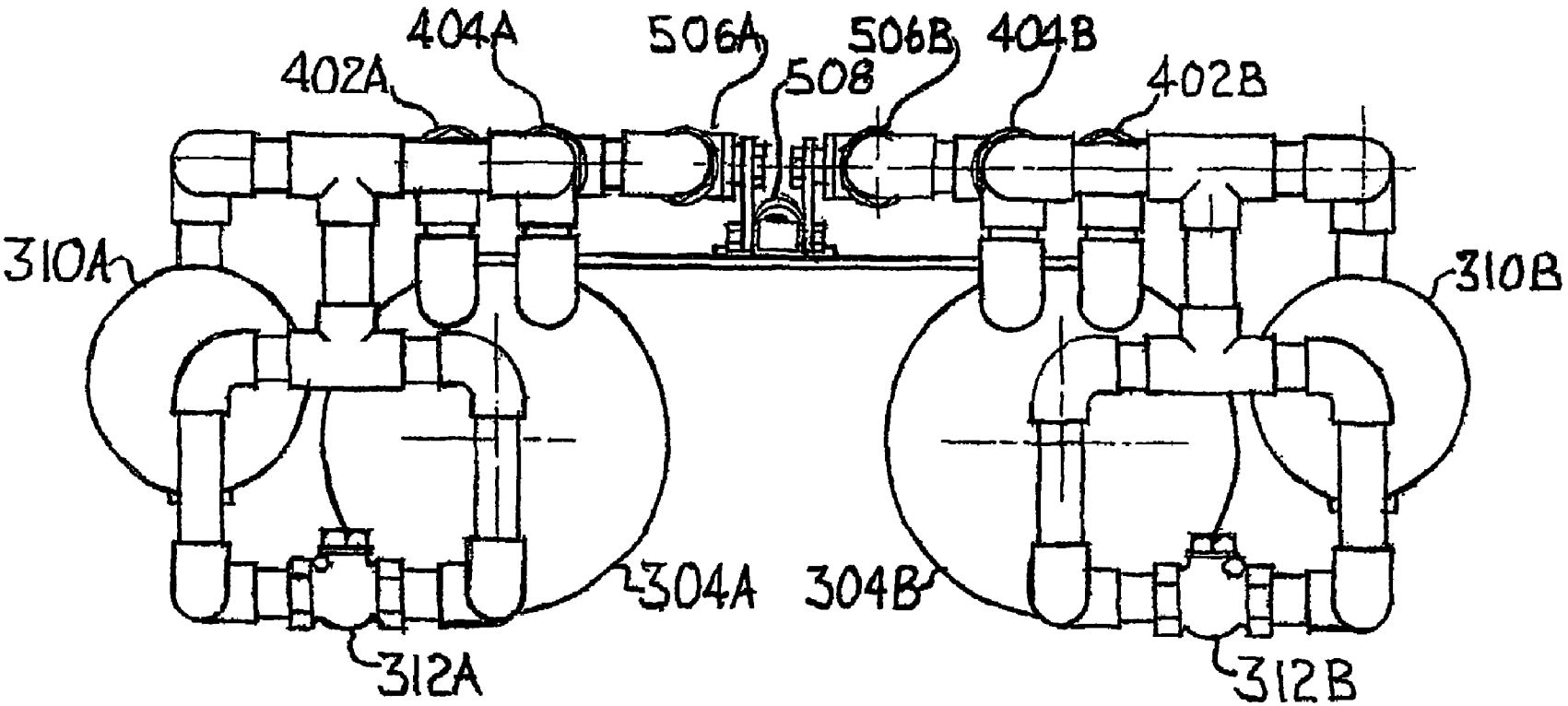
FIG. 7 is a cross-sectional view through line A-A' of FIG. 4.
Figure 8:
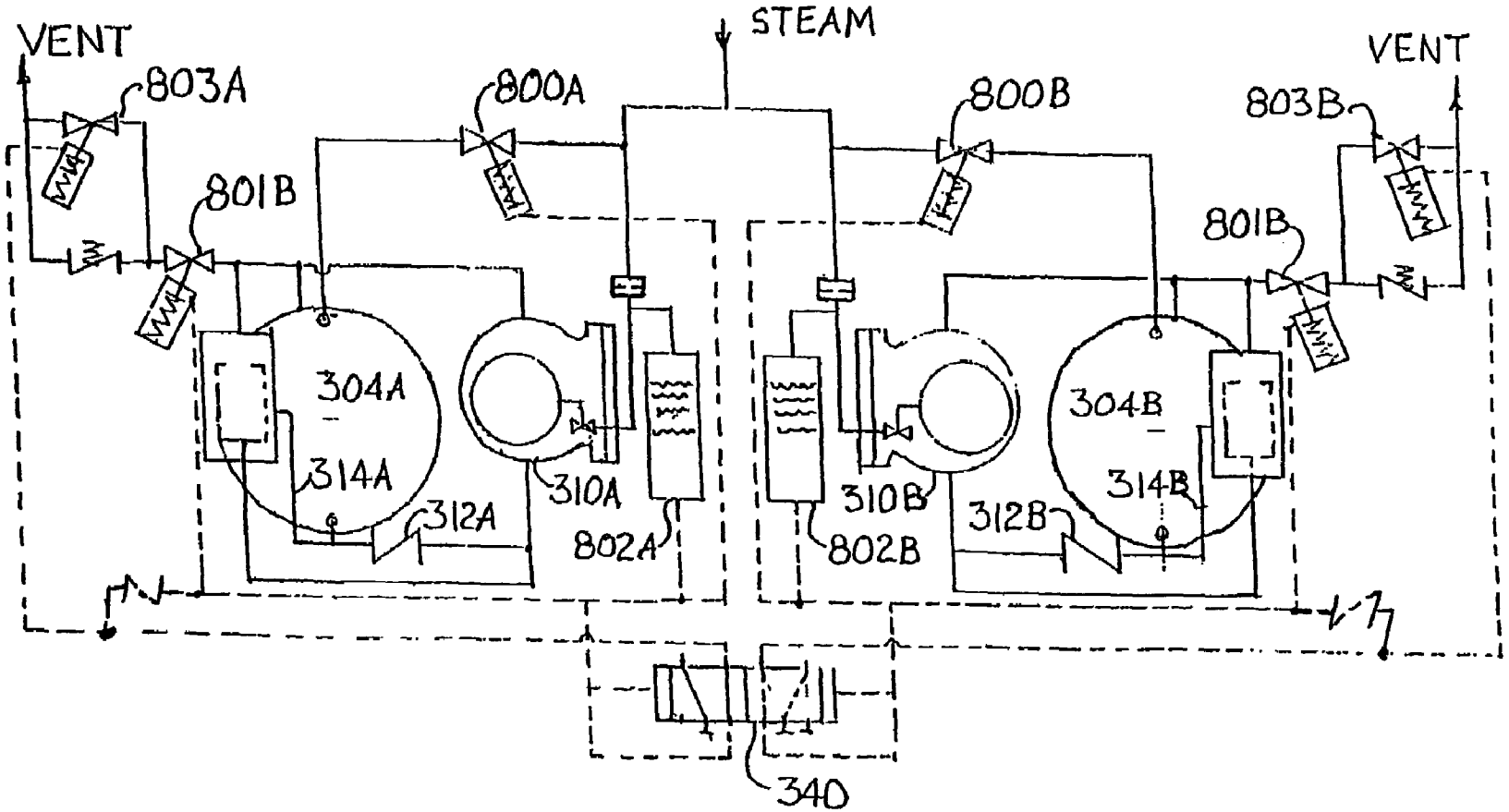
FIG. 8 is a schematic view of a further embodiment where piston-operated valves are used.
Figure 9:
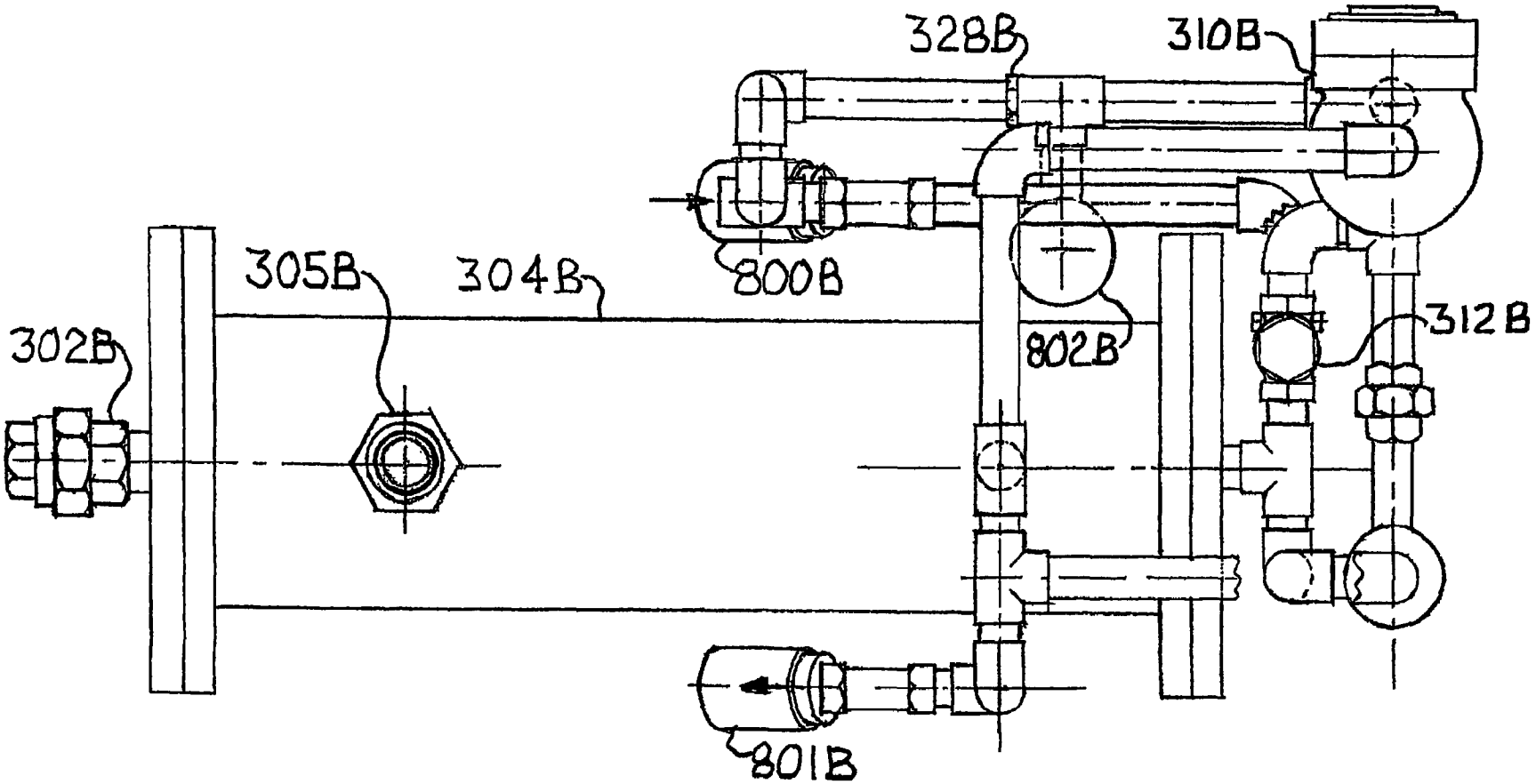
FIG. 9 is a plan view of part of the pump apparatus shown in FIG. 8.
Figure 10:
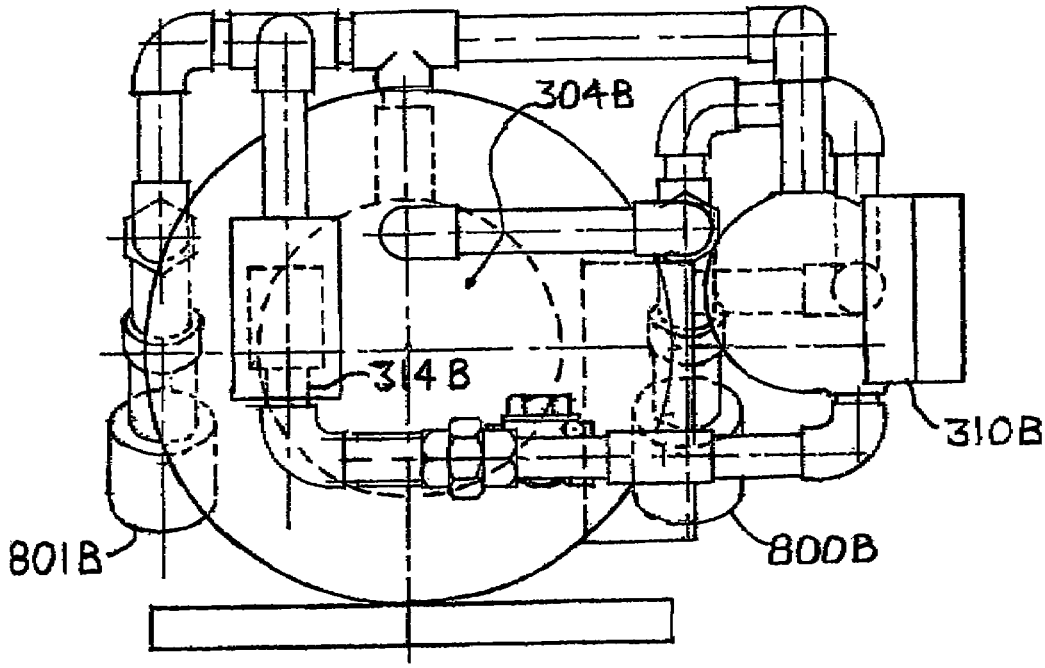
FIG. 10 is an end view of the apparatus of FIG. 8.
Figure 11:
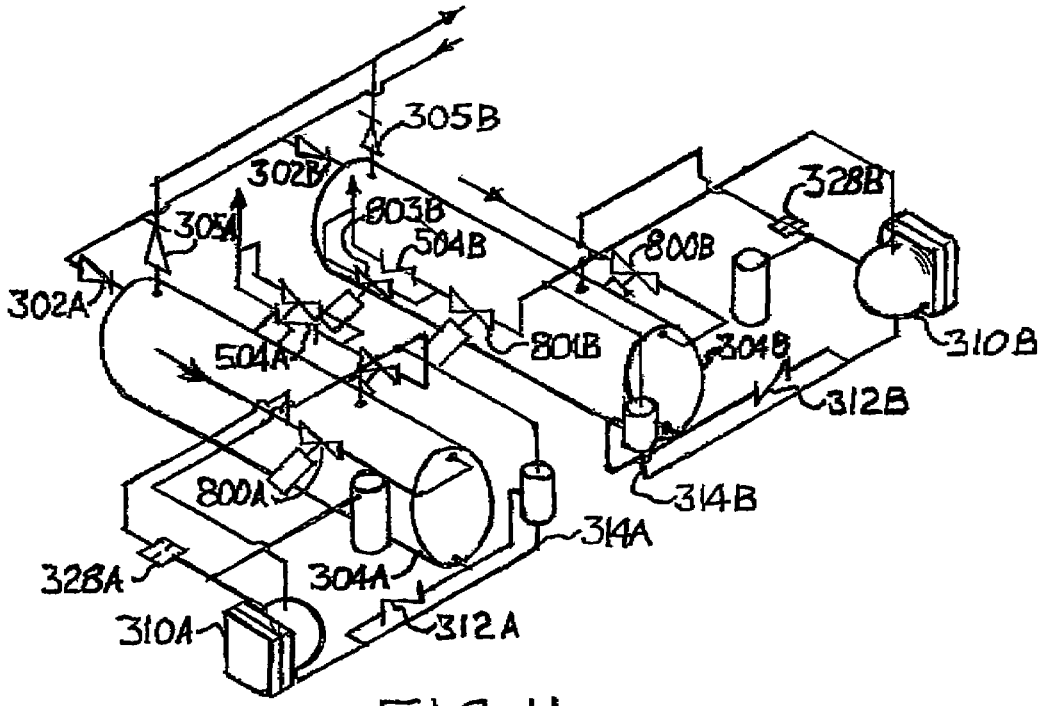
FIG. 11 is a schematic perspective view of the apparatus of FIG. 8.

FIGS. 5 to 7 show diagrammatically such a duplex arrangement in a pump arrangement 500. Again, substantially similar parts are given the same reference numerals as in the earlier embodiments. The pump 500 includes two chambers 304A, 304B, each chamber having its own associated components labelled with a suffix A or B. Descriptions of parts or operations will not be duplicated herein where it is apparent from the Figures that two corresponding components exist. Each chamber has its own thruster cylinder 410. Preferably, the cylinder 410 is of the single acting, spring return pattern, although a double-acting cylinder could be used. Each cylinder 410 operates a motive steam valve 402 and an initial venting valve 404. Each cylinder 410 has a respective controlling shuttle valve 340, each responding to the pressure in pipe 326 substantially as described previously. The initial venting valve on each chamber discharges through a non-return valve 504. This offers a slight resistance to flow, by the weight of the valve disc. Alternatively, the disc may be spring-loaded.

An extra vent valve 506 is fitted in a bypass around each non-return valve 504. Both valves 506A, 506B for both of the chambers 304A, 304B are operated by one double-acting thruster 508. The valves are arranged so that if either valve is closed, then the other valve is opened to complete the venting of its respective chamber. Each end of the thruster 508 is supplied with air at the same time as the respective thruster 410 that opens the steam supply valve on one of the pumping chambers. When one chamber has filled with condensate, its float pilot valve 318 is opened and the pressure in its pipe 326 is lowered. The shuffle valve 340 admits air to the thruster 410 and moves the steam valve to "open" and the initial vent valve 404 to "closed". The double-acting thruster cylinder 508 closes the vent valve 506 on this chamber and opens the vent valve 506 on the second chamber. The second chamber can then fill.

When the contents of the first chamber 304A have been pumped down to the "empty" level, the float pilot valve 318A closes. Pressure in the pipe 326A increases, changing the position of the shuttle valve 340A. The valve 340A vents the thruster 410A which closes the steam inlet valve 402A, and opens the initial vent valve 404A. Air is vented also from thruster 508, but the piston does not move, as both ends of the cylinder are now vented. The two vent valves 506A, 506B remain closed and open, respectively, and the first chamber 304A retains sufficient pressure so that its inlet check valve 302A remains closed. Only when the second chamber 304B has filled does its pilot float valve 318B open, so that its steam valve 402B can open. Its vent valve 404B closes and the vent valve 506A of the first chamber 304A opens. The first chamber can then refill, as the second chamber is pumped out.

Each of the chambers effectively acts as a receiver tank to accept condensate when the other chamber is discharging. The two chambers 304 are thus allowed to fill and discharge alternately, making the flow of condensate to the pump virtually continuous, and discharge of the condensate into the delivery pipe may be more nearly continuous than when a single chamber is used. As no receiver tank located above the pump is needed, the apparatus requires less height than conventional arrangements. Further, the pump chamber need not usually contain any moving parts and so requires minimal maintenance.

When the pressure of the motive steam is reasonably constant, the pressure of the air supplied to the pilot port of the shuttle valve opposite to the one sensing the conditions in pipe 326 is set by adjustment of the control spring of a standard pressure-regulating valve 336. Alternatives that could be used if the steam pressure is subject to variations in a particular installation include:

a) replacing the adjustment spring of the regulator with a pressure tight housing, and connecting the steam pressure to this. A light return spring below the diaphragm would be chosen so that the valve controlled the air pressure to about ½ bar below the steam pressure.

b) Using an extended pilot valve cover on that end of the shuttle valve connected to pipe 326 to allow the use of a small spring, to bias this end of the shuttle by the equivalent of ½ bar pressure. Instead of using an air pressure regulator, the pressure of the steam supply is applied through a U-seal to the opposing pilot.

Pressure-powered pumps of any type presently available, having large internal float mechanisms with springs to store energy, or using level switches or probes to control motorised valves, will each accept liquid from a large receiver mounted above them. To obtain sufficient pumping capacity to deal with larger loads, two of these pumps may be used in parallel, with a common receiver above them. The system including duplex pumps described above can be adapted to obviate the need for the receiver and to provide a somewhat lower profile unit. The vent, or exhaust line, from each pump can be simply fitted with a line size check valve having a spring-loaded valve disc. Each check valve can have a bypass pipe in which a ball valve is fitted. The two ball valves are operated by a common double-acting thruster cylinder as described above. This is supplied with compressed air through a 5-port shuttle valve, and the two pilot ports of the shuttle valve are each connected to points below the minimum water level in the respective pumps.

When the motive steam valve on either pump chamber is open, the pressure on the liquid is then sensed at the 5-port shuttle valve. This changes position and the thruster opens the ball valve in the vent line of the other pump. The two pumps then operate alternately, and one chamber is always available to accept liquid while the other pump is emptying.

It is desirable that the float chamber 310 fills as quickly as possible when the level of the pumped liquid has reached the top of the vertical pipe 314. To this end, the pipe 314 can be connected into a section of pipe of greater diameter, itself containing a central vertical overflow pipe. The end of this overflow pipe can be a 25.4 mm or 1" nominal bore pipe socket. The rim of this socket can have a circumference of around 127 mm or 5", over which liquid can overflow much faster than through a 12.7 mm or 0.5" horizontal nominal bore pipe.

In another alternative embodiment of the invention, the quarter-turn ball valves 402/404 are replaced with piston-operated on-off valves, e.g. Spirax Sarco PF61G NC/NO valves. The pistons may be operated by compressed air in the same way as the thruster valves described above. The embodiment of FIGS. 8 to 11 incorporates such valves 800A/B, 801/AB which are actuated by water pressure.

The two steam pressures that may be present between the fixed orifice 328 and the float-operated valve 318 are connected to a chamber 802 that replaces the u-seal 406. The chamber 802 may simply be a length of about 100 mm or 4" of 50.8 mm or 2" nominal bore pipe and is filled to an appropriate level with water. The cylinders of the piston-actuated valves 800, 801 are connected to the chamber 304 by pipes so that the control pressures are transmitted to them by water pressure. The motive steam supply valve 800 is of the "normally-open" pattern and the vent valve 801 is "normally-closed".

When the float-operated valve 318 is closed, full motive steam pressure is applied to close the steam valve 800 and open the vent valve 801. Opening of the float-operated valve 318 when the pumping chamber 802 is full lowers the pressure in the chamber and this is applied to the actuating pistons 800, 801. The valve 803 can be used to assist in completing the venting of the chamber and remove any residual pressure. The chamber vent valve 801 then closes and the motive steam valve 800 opens.

In another embodiment the two pumps may be connected together by means of a further valve component having an automatic valve which is fitted in the inlet line of each chamber 304A, 304B (normally before the inlet valve 302). The automatic valve can operate such that when the chamber of one pump is discharging, the other pump is receiving liquid through its inlet.

The invention claimed is:

1. Pump apparatus (1) including:

a first container including a chamber (304), an inlet (302) and an outlet (305), the chamber being pressurisable to effect discharge through the outlet;

a control apparatus for causing periodic pressurisation and depressurisation of the chamber as part of a pressurization/depressurization cycle in response to a level of liquid in the first container, wherein the control apparatus includes a pilot valve (318) located in a second container (310) connected to receive liquid from the first container from a source other than said outlet when the level of liquid in the first container rises to a first predetermined level, the pilot valve being configured to open when the liquid level in the second container is sufficiently high, and to trigger a pressurisation of the chamber of the first container, and to close in response to the liquid level in the second container falling below a second predetermined level, which triggers the depressurisation, the state of the pilot valve determining pressure within a portion (326) of the apparatus, and a shuttle valve (340) configured to change state directly in response to the pressure within the portion of the apparatus, the state of the shuttle valve determining whether motive gas enters into, or is vented from, the first container, thereby implementing the pressurisation/depressurisation cycle.

2. Pump apparatus according to claim 1, wherein the second container (310) has its base at a relatively higher location than the base of the first container (304).

3. Pump apparatus according to claim 1, further including a compressed air supply (320), the compressed air being used as the motive gas.

4. Pump apparatus according to claim 1, further including a compressed air supply (320), wherein the compressed air is supplied to or vented from a thruster cylinder (410) which operates to supply or vent steam for pressurisation/depressurisation of the first container (304).

5. Pump apparatus according to claim 1, further including another said pump apparatus connected in parallel to a first pump apparatus, each said pump having a further valve component (402, 404) connected to a line for venting the motive gas from at least the first container (304A, 304B) of each said pump, the further valves configured to open the venting valve (404A) of one said pump when the venting valve (404B) of the other said pump is closed.

6. Pump apparatus according to claim 1, wherein steam is used as the motive gas.

7. Pump apparatus according to claim 1, wherein the outlet (305) includes a non-return valve intended to allow liquid to pass therethrough only when the pressure of the liquid exceeds a predetermined threshold.

8. Pump apparatus according to claim 7, wherein the second container (310) is relatively small compared with the first container (304).

9. Pump apparatus according to claim 7, wherein the second container (310) has its base at a relatively higher location than the base of the first container (304).

10. Pump apparatus according to claim 7, wherein the first (304) and second (310) containers are linked by a pipe or line (308) having a non-return valve (312).

11. Pump apparatus according to claim 1, wherein the second container (310) is relatively small compared with the first container (304).

12. Pump apparatus according to claim 11, wherein the second container (310) has its base at a relatively higher location than the base of the first container (304).

13. Pump apparatus (1) including:

a first container including a chamber (304), an inlet (302) and an outlet (305), the chamber being pressurisable to effect discharge through the outlet;

a control apparatus for causing periodic pressurisation and depressurisation of the chamber as part of a pressurization/depressurization cycle in response to the level of liquid in the first container, wherein the control apparatus includes a pilot valve (318) located in a second container (310) connected to receive liquid from the first container through a pipe or line other than said outlet when the level of liquid in the first container rises to a first predetermined level, the pilot valve being configured to open when the liquid level in the second chamber 310 is sufficiently high to trigger a pressurisation of the chamber of the first container and to close in response to the liquid level in the second container falling below a second predetermined level, which triggers the depressurisation, wherein the first (304) and second (310) containers are linked by said pipe or line (308) having a non-return valve (312).

14. Pump apparatus (500) including two pumps, each said pump respectively including:

a first container including a chamber (304), an inlet (302) and an outlet (305), the chamber being pressurisable to effect discharge through the outlet, a control apparatus (402, 404, 508) for causing periodic pressurisation and depressurisation of the chamber in response to the level of liquid in the container, said liquid having a high level and a low level, said low level triggering the depressurization, said control apparatus including a shuttle valve (340) configured to change state directly in response to the pressure within a portion of the apparatus, the state of the shuttle valve determining whether motive gas enters into, or is vented from, the first container, thereby implementing the pressurisation/depressurisation cycle; the apparatus being arranged so that when one said pump is discharging liquid from a respective outlet, the other pump is receiving liquid through a respective inlet, each said respective inlet receiving said liquid from a source other than said respective outlet , and a pilot valve configured to open when the liquid level in a second container is sufficiently high to trigger a pressurization of the chamber of the first container and to close in response to the liquid level in the second container falling below a predetermined level.

15. Pump apparatus according to claim 14, wherein the two pumps are connected together by means of a further valve component (402, 404) connected to a line for venting the motive gas from at least the first container of each said pump, the further valve configured to open the venting valve (404A) of one said pump when the venting valve (404B) of the other said pump is closed.

16. Pump apparatus according to claim 14, wherein the two pumps are connected together by means of a further valve component having an automatic valve in the inlet line (302) of each said first chamber (304A, 304B), the valves arranged such that when the chamber (304A) of one said pump is discharging, the chamber (304B) of the other said pump is receiving liquid through its inlet.

* * * * *

UNITED STATES PATENT AND TRADEMARK OFFICE

CERTIFICATE OF CORRECTION

PATENT NO. : 7,648,345 B2
APPLICATION NO. : 10/518633
DATED : January 19, 2010
INVENTOR(S) : Armer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 788 days.

Signed and Sealed this

Twenty-eighth Day of December, 2010

David J. Kappos

David J. Kappos
*Director of the United States Patent and Trademark Office*